US007506725B2

(12) United States Patent
Kuo et al.

(10) Patent No.: US 7,506,725 B2
(45) Date of Patent: Mar. 24, 2009

(54) CONTROL STRUCTURE OF BALL SCREW TYPE ELEVATOR

(75) Inventors: Chang-Hsin Kuo, Taichung (TW); Tien-Tzu Liao, Taichung (TW)

(73) Assignee: Hiwin Technologies Corp., Taichung Industry Park, Taichung (TW)

( * ) Notice: Subject to any disclaimer, the term of this patent is extended or adjusted under 35 U.S.C. 154(b) by 362 days.

(21) Appl. No.: 11/304,953

(22) Filed: Dec. 14, 2005

(65) Prior Publication Data

US 2007/0131485 A1 Jun. 14, 2007

(51) Int. Cl.
*B66B 9/02* (2006.01)
*B66B 11/04* (2006.01)
*B66B 5/02* (2006.01)

(52) U.S. Cl. ..... 187/267; 187/277; 187/269; 318/11; 318/15

(58) Field of Classification Search ..... None
See application file for complete search history.

(56) References Cited

U.S. PATENT DOCUMENTS 5,080,200 A * 1/1992 Gibson ..... 187/252
5,234,310 A * 8/1993 Driver ..... 414/540
6,883,795 B2 * 4/2005 McCormick et al. ..... 269/239
7,121,539 B2 * 10/2006 McCormick et al. ..... 269/239
2005/0056492 A1 * 3/2005 Nielsen ..... 187/267
2006/0102697 A1 * 5/2006 Nagai et al. ..... 228/101
2006/0113940 A1 * 6/2006 Nagai et al. ..... 318/434
2007/0007082 A1 * 1/2007 Nielsen ..... 187/267
2007/0176575 A1 * 8/2007 Nawa et al. ..... 318/800
2007/0182350 A1 * 8/2007 Patterson et al. ..... 318/432

FOREIGN PATENT DOCUMENTS

JP 07097158 A * 4/1995
JP 08026620 A * 1/1996
JP 2000038271 A * 2/2000
JP 2001287880 A * 10/2001
JP 2001348175 A * 12/2001
JP 2004161468 A * 6/2004

* cited by examiner

*Primary Examiner*—Lincoln Donovan
*Assistant Examiner*—Eduardo Colon-Santana
(74) *Attorney, Agent, or Firm*—Charles E. Baxley

(57) ABSTRACT

The rolling friction force of ball screw is much small than the sliding friction force of it. Using ball screw as the transmission mechanism for elevator, so as to find the differences of friction forces between rolling motion and sliding motion. Besides, the current of motor has the obvious relationship to the driving force of motor, we use current of motor for ball screw type elevator to monitor the system. And, before the serious damage occurring, the monitor system can find the different form the current of motor, and make the operation for elevator safer.

15 Claims, 3 Drawing Sheets

CONTROL STRUCTURE OF BALL SCREW TYPE ELEVATOR

BACKGROUND OF THE INVENTION

1. Field of the Invention

The present invention relates to a control structure of ball screw type elevator, and more particularly to a more safe ball screw type elevator that utilizes ball screw as a transmission mechanism, when a minor failure occurs, it can be detected immediately.

2. Description of the Prior Art

The existing elevators sold on the market are generally divided into two types: the first one is steel cable type elevator that uses a draw machine to pull the steel cable, so as to raise or lower the elevator car. The second one is hydraulic type elevator that utilizes an oil cylinder to lift or lower the elevator car.

The component of a steel cable type elevator liable to cause damage is the steel cable pulling the elevator, if the steel cable is broken, the elevator car will crash. The method for determining whether a steel cable will be broken is to check if there is any partial crack in the steel cable or to check if the diameter of the steel cable has obviously become smaller. Unfortunately, partial crack in the steel cable or a decrease in the diameter of the steel cable is very difficult to be detected by an automatic elevator checking system. In this case, regular safety check must be carried out regularly and must be performed by professional personal. For the sake of safety, regular safety check gives no cause for criticism; however, the elevator's steel cable is always covered with slimy grease, so that it is difficult to find if there is partial crack in the steel cable. Although safety check is done regularly, it is still not for sure that the partial crack of the steel cable can be detected. As a result, the elevator will have a lurking danger of being broken.

The main trouble of the hydraulic type elevator is that the oil cylinder and the oil pipe are liable to be broken. If the oil cylinder or the oil pipe is broken, the elevator will crash. However, determining whether the oil cylinder or the oil pipe is broken is not an easy thing. A conventional method is to check whether the hydraulic system leaks, because the high pressure will make oil leaking from the hydraulic system once the oil cylinder or the oil pipe is broken. However, it cannot ensure that the hydraulic system will not be broken before the next regular safety check, although the oil cylinder and the oil pipe are not found to have crack during the current safety check. And once a crack occurs in the oil cylinder, however, stress is always concentrated around the crack, this will make the crack wide, and lead to the occurrence of an accident. Unfortunately, a small crack of the hydraulic system cannot be easily detected by the automatic elevator checking system, and the safety check is usually carried out once a year. Therefore, it cannot ensure that the hydraulic system will not be broken before the next regular safety check, although the oil cylinder and the oil pipe are okay during the current safety check.

That is, when the conventional elevator is broken, it cannot be detected in time by the automatic checking system, therefore, the conventional elevator still has some blind spots in terms of safety. Furthermore, some designs are still unable to detect the partial and minor abnormal condition even during the regular safety check. Therefore, the conventional elevator still has many problems that need to be improved.

The present invention has arisen to mitigate and/or obviate the afore-described disadvantages.

SUMMARY OF THE INVENTION

The primary object of the present invention is to provide an elevator with automatic detection capability, so that when the transmission mechanism of the elevator is failure, it can be detected and repaired in time.

The secondary object of the present invention is to provide a safe control structure for a ball screw type elevator, when a minor failure of the elevator occurs, it can be detected immediately.

The further object of the present invention is to provide a control structure of elevator, for facilitating the treatment of abnormal condition and improving the safety of the elevator.

To achieve the above-mentioned objects, firstly the present invention is focused on how to use an automatic detecting method to detect whether there is anything wrong with the elevator. However, before the steel cable is broken, the load of the elevator car and the draw machine will not change, only the length of the steel cable will change a little. Such small change in length is not easy to be detected by a simple position detecting device. The similar problem also occurs in the hydraulic system, the pressure of hydraulic will decrease in case of an oil leakage. However, the pump compensation will make the oil leakage difficult to be detected automatically.

To overcome this problem, the present invention firstly thinks what mechanism will have an obvious change in current value or voltage value when a failure occurs. After many trials, we found that ball screw has such characteristics: when the ball screw is failure, it is almost because the ball circulation system of the nut has been damaged or the rolling elements have been worn off, causing sharp increase in the friction force of the ball screw, and the friction force will be increased as high as 10-20 times. The rolling friction coefficient of an ordinary ball screw will be less than 0.01, and the sliding friction coefficient between two steel materials will be up to 0.1-0.2. Therefore, when the rolling balls of the ball screw shaft completely stop rotating and make the sliding friction coefficient increase to 0.1-0.2, it can be detected very easily. But at this moment, it will be resulted in an overload of the motor and the power source will accordingly be interrupted, and the elevator car will be unable to move up and down.

In addition, the study of the present invention found that when the friction force of the ball screw increases, the normal forces acted on the ball screw are the same, an increase of the friction coefficient will lead to an increase in friction force, and accordingly it will cause an increase in the temperature of the ball screw. Even worse, it will probably lead to a phenomenon of metal partial melting, and even may cause a jam of the ball screw, accordingly the elevator car will be unable to move. Fortunately, the study found that the increase of the friction force of the ball screw is not too fast to be detected or responded. Therefore, just installing a detecting device in the elevator and dealing with detected minor errors in time can prevent the occurrence of damage, and thus the elevator will be safer.

Therefore, the present invention specially chooses a ball screw to drive the elevator car vertically. An electric motor is employed to rotate the ball screw, a motion control unit serves to provide electric energy for the electric motor, a current detecting unit is disposed between the motion control unit and the electric motor for detecting the current value of the motion control unit and the electric motor and transmitting the detected current value to a logic control unit. The logic control unit is used for analyzing the current value detected by the current detecting unit and comparing the detected current value with predetermined point's normal value, when the detected current value is out of normal range, it will be treated as abnormal condition. Therefore, any abnormal condition of the elevator can be detected in time before a serious damage occurs, thus preventing occurrence of an accident.

The present invention will become more obvious from the following description when taken in connection with the accompanying drawings, which show, for purpose of illustrations only, the preferred embodiment in accordance with the present invention.

DETAILED DESCRIPTION OF THE PREFERRED EMBODIMENT

Figure 1:
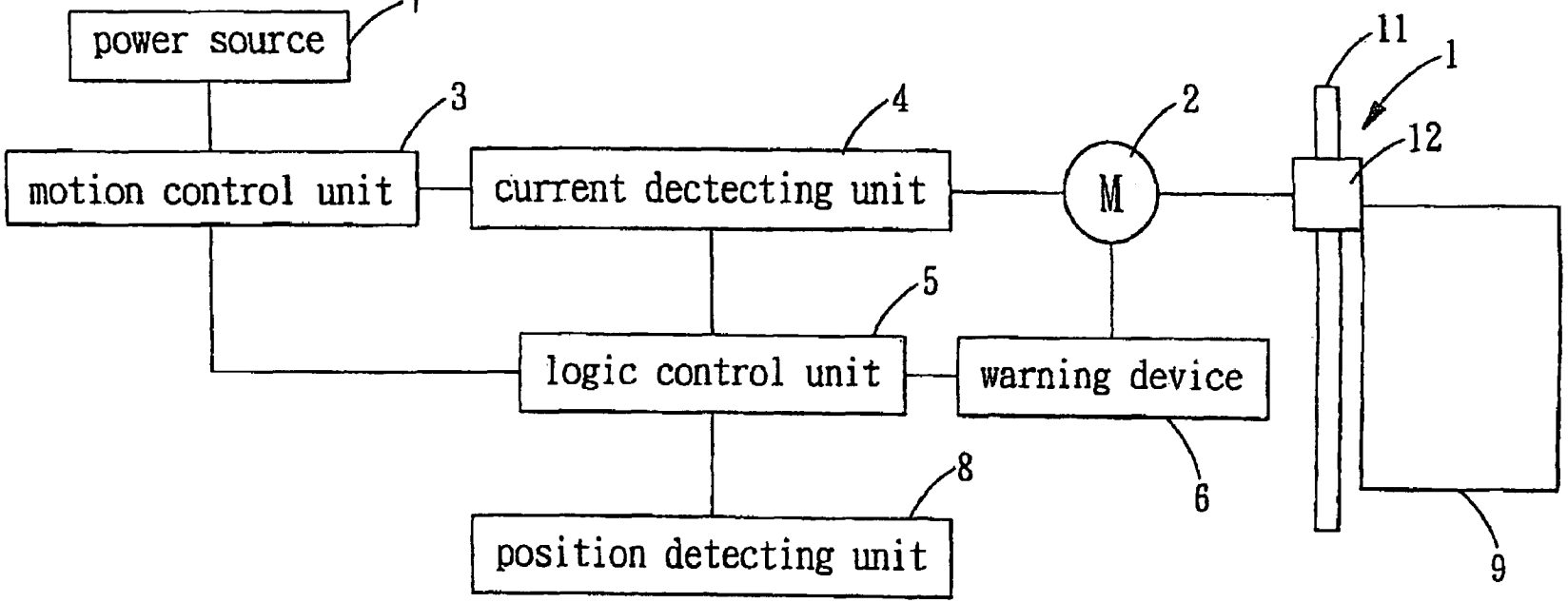
FIG. 1 is a block diagram of showing a control structure for an elevator in accordance with the present invention.

FIG. 1 is an illustrative diagram of showing a control structure for an elevator in accordance with the present invention, in which, the control structure comprises: a ball screw 1, an electric motor 2, a motion control unit 3, a current detecting unit 4, a logic control unit 5, a warning device 6, a power source 7 and a position detecting unit 8. The power source 7 is connected to and provides electric energy for the motion control unit 3. The power source 7 can be a DC power source, a single-phase power source, a three-phase power source, etc. All types of electronic components need electric energy for working. Besides providing electric energy for the motion control unit 3, the power source 7 also can be used as a direct or indirect power supplier for supplying power to other electronic components.

The motion control unit 3 serves to provide electric energy for the electric motor 2 and to control the motion parameter of the electric motor 2. The motion parameter includes the moving direction of the electric motor 2 for controlling upward and downward motion of the elevator car 9. In addition, the motion parameter of the electric motor 2 also includes the rotating speed of the electric motor 2 for controlling the moving speed of the elevator car 9. The electric motor 2 can be a DC motor or AC motor, and generally it takes the form of an AC single-phase or three-phase induction motor and serves to rotate the ball screw 1, thus making the elevator car 9 moves up and down along an axis of the ball screw 1. The current detecting unit 4 is disposed between the motion control unit 3 and the electric motor 2 for detecting the current value of the motion control unit 3 and the electric motor 2 and transmitting the detected current value to the logic control unit 5. The current detecting unit 4 of FIG. 1 is disposed between the motion control unit 3 and the electric motor 2 for detecting the current value of the electric motor 2. However, if it does not require a high degree of sensitivity, the current detecting unit 4 can be disposed between the power source 7 and the motion control unit 3 and serves to monitor the total current value of the monitor system, such arrangement also can provide a similar monitoring effect. Since, in an elevator system, the power consumption of the electric motor 2 is the highest, the elevator system's power consumption will be approximately equal to the power consumption of the electric motor 2. Therefore, monitoring the total current value of the monitor system also has a similar monitoring effect under a condition that the respective units of an elevator system are in a good condition (no severe power leakage or short circuit).

The logic control unit 5 serves to receive the signal of current value from the current detecting unit 4 and to compare the detected current value with the normal value of the predetermine points. When the detected current value is out of normal range, it will be treated as abnormal condition.

The electric motor 2 serves to rotate the ball screw 1, so as to drive the elevator car 9 to move up and down along the axis of the ball screw 1. The ball screw 1 includes a screw shaft 11 and a nut 12. Since the ball screw 1 utilizes steel balls as motion medium between the screw shaft 11 and the nut 12, plus the steel balls have a very small friction force and a high efficiency of mechanical transmission. Whatever driving methods are used, such as moving the nut 12 by rotating the screw shaft 11, or rotating the nut 12 and making it move along the screw shaft 11, they are all practical options. Therefore, the electric motor 2 of the control structure of elevator of FIG. 1 can be connected to the screw shaft 11 of the ball screw 1 for rotating the screw shaft 11, thus making the nut 12 move up and down along the screw shaft 11. Or, the electric motor 2 also can be connected to the nut 12 of the ball screw 1 for rotating the nut 12 and making it move up and down along the screw shaft 11.

The logic control unit 5 and the warning device 6 in FIG. 1 are connected to each other, so as to make it easy for the logic control unit 5 to start the warning device 6 in case that the detected current value is determined as abnormal, thus informing the related people that the elevator is in an abnormal condition. The position detecting unit 8 is used to detect if the elevator car 9 has passed or reached a specified position, thus determining whether the electric motor 2 runs at a uniform speed. Or, the position detecting unit 8 can be used to detect if the elevator car 9 is approaching a stop at a certain floor, so as to decide if it is necessary to slow down and stop at the floor.

Figure 2:
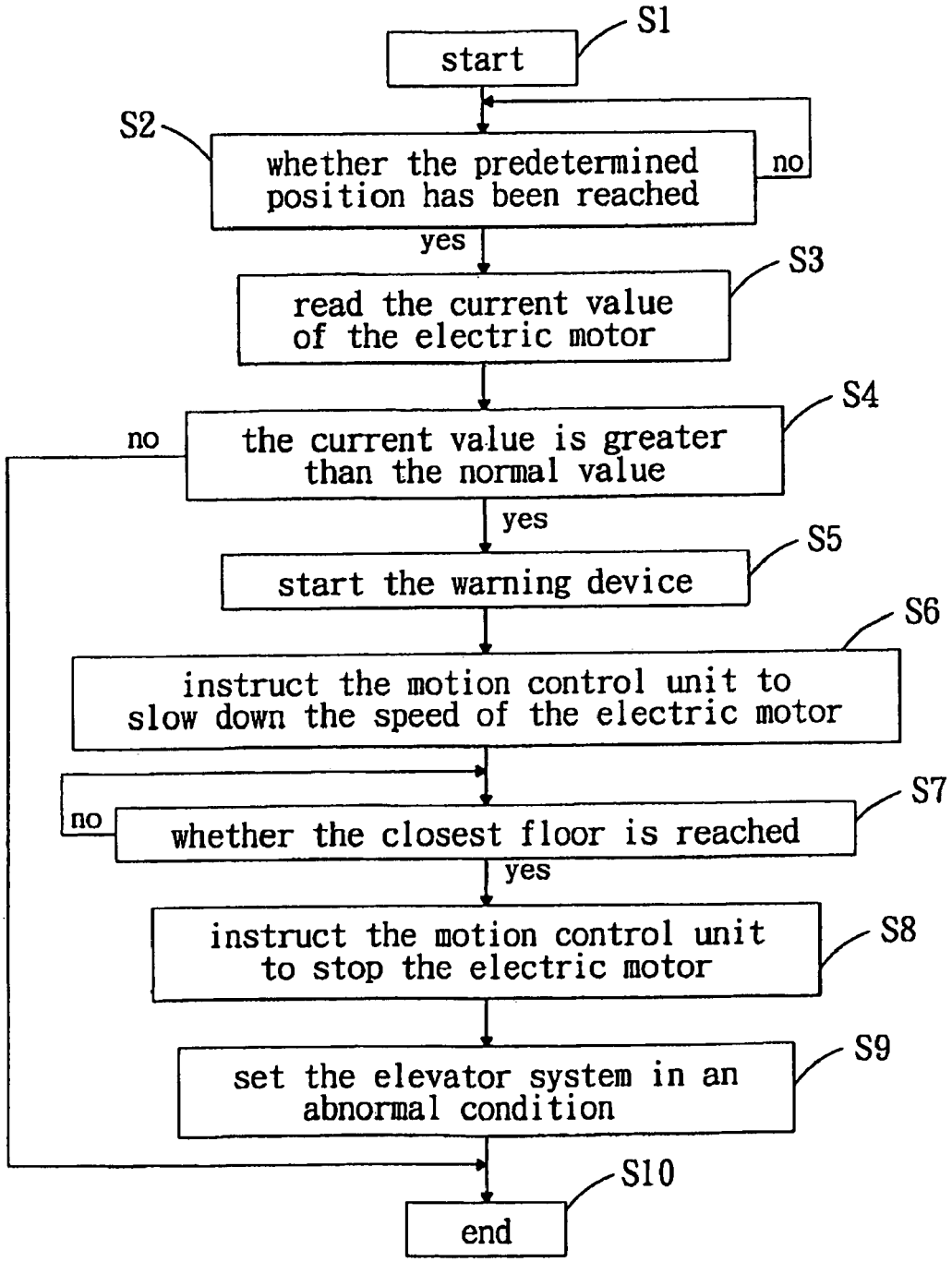
FIG. 2 is a logic flow chart of the logic control unit in accordance with the present invention.

FIG. 2 is a logic flow chart of the logic: control unit 5. For easy description, S is used to represent each step of the flow chart. The first step S1 of the logic flow chart is "start" which means the starting point of the logic flow chart. The second step S2 is a decision logic for determining whether the predetermined position has been reached. When the electric motor 2 accelerates or decelerates, it requires relatively high current value. The electric energy of the electric motor 2 is mainly used to change the kinetic energy of the elevator car 9 and its counterweight (not shown), and it seems that the electric energy of the electric motor 2 has little thing to do with the value of the friction force of the screw ball 1. Therefore, in order to know whether the electric energy of the electric motor 2 has something to do with the friction force of the ball screw 1, the best time for comparing the current value is at the time the electric motor 2 rotates stably. Therefore, the second step of the logic flow chart is to determine if a predetermined position is reached. If it is, then step S3 of the logic flow chart can be carried out. If the predetermined position is not reached, the step S2 is to be carried out continuously. Until the condition of step S2 is satisfied, step S3 then can be done. The predetermined position in step S2 can be defined by the following two methods: the first method is to define an acceleration time of the electric motor 2, when the logic control unit 5 transmits a motion signal of the electric motor 2 to the motion control unit 3, the timer in the logic control unit 5 will start counting. When the counted time reaches a given value, it means that the predetermined position is reached. The second method is to utilize a position detecting unit 8 (as shown in FIG. 1), and arrange it in the area in which the elevator car moves at a uniform speed. When the position detecting unit 8 works, it means that the elevator car moves at a uniform speed. At this moment, the electric motor 2 should move at a uniform speed. Therefore, when the logic control unit receives the signal from the position detecting unit 8, the predetermined position of the step S2 of the logic flow chart will be determined to be reached.

The step S3 of the logic flow chart is to read the current value of the electric motor, in this step, the logic control unit 5 will read the current value of the current detecting unit 4. When the electric motor 2 is the AC three-phase induction motor, the current value of the respective cables connected to the electric motor 2 will probably be different from one another. A conservative method is to measure the current value of every cable. However, when the electric motor 2 functions well and no phase loss occurs, the respective cables connected to the electric motor 2 are approximately equal in terms of current value. Therefore, it is an economic and practical method to only detect the current value of one of the cables of the electric motor 2.

The step S4 of the logic flow chart is to compare if the detected current value is greater than the normal value. If the detected current value is not greater than the normal value, it means that the ball screw 1 is in a normal condition, and the elevator system is still safety. At this moment, the logic decision ends up with skipping to step S10. If the detected current value in step S3 is greater than the normal current value, it means that the elevator system is damaged, and the steps S5-S9 are going to be carried out.

The step S5 of the logic flow chart is to start the warning device 6, so as to warn the people that the elevator is in an abnormal state and needs to be repaired as soon as possible. The warning device 6 mentioned here can be a buzzer or a flash light, or even both of them, etc. And the warning device 6 can be located at the elevator door at each floor, or/and at the management center of a building.

The step S6 of the logic flow chart is to instruct the motion control unit 3 to slow down the speed of the electric motor 2. If the ball screw 1 is in an abnormal condition and its friction force is increased, the larger the friction force is, the greater the heat generated will be, and accordingly it will cause an increase in the temperature of the ball screw 1, and even worse, it will probably lead to a phenomenon of metal partial melting. The mechanism for causing the metal partial melting is similar to that for causing the friction welding. To prevent the damage to the system from worsening, slowing down the speed of ball screw 1 by slowing down the speed of the electric motor is the first choice that should be taken. The slowdown of the rotating speed of the ball screw 1 and the reduction of the heat produced in a unit time, can prevent the occurrence of the partial metal melting. Therefore, step S6 is set to instruct the motion control unit 3 to slow down the speed of the electric motor 2.

The primary thing to be done after slowdown of the electric motor 2 is to evacuate the people to a safer place, that is to stop the elevator car at a certain floor and open the door of the elevator car for facilitating the evacuation. Meanwhile, it is necessary to stop the elevator car at the closest floor and stop the elevator system from overly moving, so as to prevent the occurrence of further damages and accidents. The best choice is to stop it at the closest floor. Therefore, the step S7 of the logic flow chart is to determine whether the closest floor is reached. If the closest floor has not been reached yet, that means that the elevator door cannot be opened, and it is more dangerous at this moment. So, it has to keep determining until the condition is satisfied. After the condition of the step S7 is satisfied, then the step S8 will be carried out.

Step S8 of the logic flow chart is to instruct the motion control unit 3 to stop the electric motor 2, so as to stop the elevator car 9 at a certain floor of a building, and then open the elevator door for facilitating the people to evacuate from the elevator car 9.

After the elevator car 9 stops at a certain floor and the door of the elevator car is opened, step S9 will be carried out. Step S9 is to set the elevator system in an abnormal condition, so as to compulsorily limit the operation of the elevator prior to check and repair, thus eliminating any improper operation caused dangers.

The step S10 of the logic flow chart is "finish", namely, finishing the logic determination procedures of the logic control unit.

Besides implementing the control logic as shown in FIG. 2 after the electric motor 2 is started, the logic control unit 5 also can do some other monitoring works, for example, whether the elevator car 9 is overloaded, whether the elevator car 9 has reached the target floor, and so on. Therefore, the logic control unit 5 is usually a kind of complicated circuit structure, and generally a programmable logic control (PLC) can be used as a logic control unit, so as to reduce the complexity of the circuit device.

Figure 3:
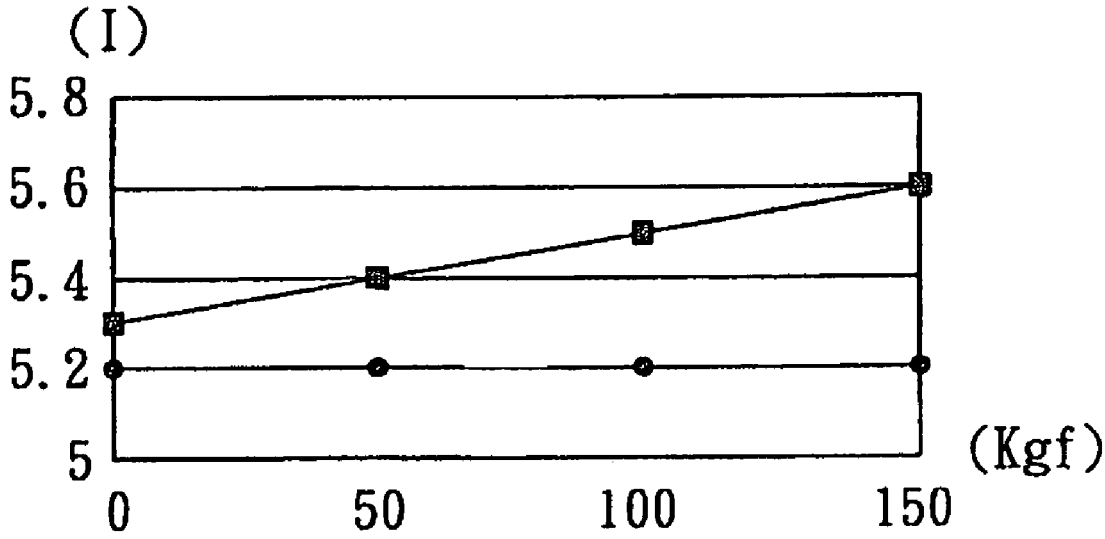
FIG. 3 illustrates the relationship between the load inside the elevator car and the current value of the electric motor.

The working load of the electric motor 2 comes from the elevator car 9, and mainly includes the inertial force causing acceleration and deceleration of the elevator car as well as its counterweight, the weight of the elevator car and its counterweight, and various friction forces. At a uniform speed, there is almost no inertial force causing acceleration and deceleration of the elevator car as well as its counterweight. The electric motor 2 mainly takes the weight of the elevator car 9 and its counterweight, and the various friction forces. The friction forces are the most important item. Therefore, when the ball screw is worn off, causing sharp increase in friction coefficient and decrease in mechanical efficient, the friction force of the system will be increased. And as a result, the current of the electric motor 2 will also be increased. In this case, when the electric motor 2 rotates stably, the current value of the electric motor 2 can be used to determine whether the system is damaged. However, for the elevator system, in addition to the changes of the friction coefficient, the weight of the people in the elevator car also will affect the total weight of the elevator car 9 and the various friction forces. To prevent the monitoring method of the present invention from being affected by the number of people in the elevator car 9, causing logic determination error, it is necessary to make sure again whether the weight loaded in the elevator car 9 has relationship with the current value of the electric motor 2. FIG. 3 illustrates the relationship between the load inside the elevator car 9 and the current value of the electric motor 2. The data in FIG. 3 is obtained under the condition that there are three people in the elevator car, so it is only measured up to 150 Kg. The tested elevator utilizes ball screw to drive the elevator car, and the current measuring points are arranged within the scope in which the electric motor 2 rotates at a uniform speed. The horizontal axes in the drawing represent the load inside the elevator car, and its unit is kilogram force (kgf). The vertical axes represent the current value of the electric motor at uniform speed, and its unit is A (Ampere). The square data points represent the measured values obtained when the elevator car 9 is moving upward, and the round data points represent the measured values obtained when the elevator car 9 is moving downward. The test result shows that the current value difference between the unloaded elevator car 9 (the load inside the elevator car 9 is 0 Kg) and the elevator car 9 with 150 Kg load is only 0.3 A, less than one tenth of an average current value. Therefore, the elevator system can be considered as abnormal and needs to be repaired as soon as possible if the current value increases 10%. In order not to make the determination method too sensitive and prevent the current noise from being mistaken for the abnormal signal of the elevator system, the reference value of the logic control unit 5 for determining whether the current value is normal can be set at a level 30% high than normal value, so as to get a relatively conservative result. When the ball system of the nut is damaged or the relative rolling elements are worn off, the friction force of the ball screw will be increased 10-20 times. Therefore, the current increase set at 30% is already a very conservative determination method.

While we have shown and described various embodiments in accordance with the present invention, it should be clear to those skilled in the art that further embodiments may be made without departing from the scope of the present invention.

What is claimed is:

1. A control structure of ball screw type elevator comprising:

a ball screw connected to an elevator car;

an electric motor for rotating the ball screw and driving the elevator car to move upward and downward;

a motion control unit for providing electric energy for the electric motor and controlling motor parameter of the electric motor;

a current detecting unit for detecting current value of the electric motor, and for transmitting detected current value to a logic control unit; and the logic control unit for analyzing the current value detected by the current detecting unit and comparing the detected current value with predetermined point's normal value, when the detected current value is out of normal range, it will be treated as abnormal condition;

wherein the abnormal condition treatment includes slowing down the speed of the ball screw, so as to prevent abnormal temperature increase of the ball screw.

2. The control structure of ball screw type elevator as claimed in claim 1, wherein the motion parameter includes moving direction of the electric motor.

3. The control structure of ball screw type elevator as claimed in claim 1, wherein the motion parameter includes rotating speed of the electric motor.

4. The control structure of ball screw type elevator as claimed in claim 1, wherein the electric motor is connected to a screw shaft of the ball screw and serves to rotate the screw shaft and to drive a nut of the ball screw to move up and down.

5. The control structure of ball screw type elevator as claimed in claim 1, wherein the electric motor is connected to a screw nut of the ball screw for rotating the nut and making it move up and down along the screw shaft.

6. The control structure of ball screw type elevator as claimed in claim 1, wherein the predetermined points are arranged within the scope in which the electric motor rotates at a uniform speed.

7. The control structure of ball screw type elevator as claimed in claim 1, wherein the predetermined points are determined by using a timer.

8. The control structure of ball screw type elevator as claimed in claim 1, wherein the predetermined points are determined by signals of a position detecting unit.

9. The control structure of ball screw type elevator as claimed in claim 1, wherein the abnormal condition treatment includes sending out a warning signal and transmitting it to a warning device.

10. The control structure of ball screw type elevator as claimed in claim 1, wherein the abnormal condition treatment includes waiting for a floor position signal, stopping the elevator car at a closest floor, and giving a fault warning.

11. The control structure of ball screw type elevator as claimed in claim 1, wherein a reference value for allowing the logic control unit to determine whether the current value is abnormal or not, is set at 10-30% higher than the normal value.

12. The control structure of ball screw type elevator as claimed in claim 1, wherein the electric motor is a three-phase induction motor.

13. The control structure of ball screw type elevator as claimed in claim 1, wherein the current detecting unit is arranged between the motion control unit and the electric motor.

14. The control structure of ball screw type elevator as claimed in claim 1, wherein the logic control unit is a programmable logic control.

15. A control structure of ball screw type elevator comprising:

a ball screw connected to an elevator car;

an electric motor for rotating the ball screw and driving the elevator car to move upward and downward;

a motion control unit for providing electric energy for the electric motor and controlling motor parameter of the electric motor;

a current detecting unit for detecting current value of the electric motor, and for transmitting detected current value to a logic control unit; and the logic control unit for analyzing the current value detected by the current detecting unit and comparing the detected current value with predetermined point's normal value, when the detected current value is out of normal range, it will be treated as abnormal condition;

wherein the abnormal condition treatment includes waiting for a floor position signal, stopping the elevator car at a closest floor, and giving a fault warning.

* * * * *